US011786944B2

(12) United States Patent
Collins

(10) Patent No.: US 11,786,944 B2
(45) Date of Patent: Oct. 17, 2023

(54) METHOD AND KIT FOR REMOVING TRAPPED HYDROCARBONS

(71) Applicant: Aubin Limited, Aberdeenshire (GB)

(72) Inventor: Patrick Joseph Collins, Aberdeenshire (GB)

(73) Assignee: Italmatch Chemicals GB Limited, Manchester (GB)

( * ) Notice: Subject to any disclaimer, the term of this patent is extended or adjusted under 35 U.S.C. 154(b) by 62 days.

(21) Appl. No.: 17/427,975

(22) PCT Filed: Jan. 27, 2020

(86) PCT No.: PCT/GB2020/050173

§ 371 (c)(1),
(2) Date: Aug. 3, 2021

(87) PCT Pub. No.: WO2020/161469

PCT Pub. Date: Aug. 13, 2020

(65) Prior Publication Data

US 2022/0008967 A1 Jan. 13, 2022

(30) Foreign Application Priority Data

Feb. 4, 2019 (GB) ..... 1901532

(51) Int. Cl.
*B08B 9/032* (2006.01)
*B08B 9/055* (2006.01)
*B08B 9/057* (2006.01)

(52) U.S. Cl.
CPC ..... *B08B 9/032* (2013.01); *B08B 9/057* (2013.01); *B08B 9/0555* (2013.01); *B08B 2209/055* (2013.01)

(58) Field of Classification Search
CPC .. B08B 9/0555; B08B 9/057; B08B 2209/055
See application file for complete search history.

(56) References Cited

U.S. PATENT DOCUMENTS 4,569,097 A 2/1986 Echols
6,170,577 B1 * 1/2001 Noles, Jr. ..... E21B 37/00 134/22.12

FOREIGN PATENT DOCUMENTS

CN 104307819 A 1/2015
CN 107350237 A 11/2017
(Continued)

OTHER PUBLICATIONS

International Search Report for Application No. PCT/GB2020/050173 dated Jul. 17, 2020, 2 pages.
(Continued)

*Primary Examiner* — Natasha N Campbell
(74) *Attorney, Agent, or Firm* — Howard & Howard Attorneys PLLC

(57) ABSTRACT

A method of removing trapped hydrocarbons from pipework, the pipework comprising a through pipe (1) extending from an inlet to an outlet, and at least one up-pipe (2*a*, 2*b*) extending upwardly from the through pipe. The method comprises: flushing the through pipe with a water-based liquid (6) which has a density less than hydrocarbons; wherein the water-based liquid comprises a plurality of rigid containers, such as microspheres, the rigid containers each having a sealed void containing a gas. in this way, hydrocarbons in the up-pipes may be removed without hot-tapping them. The flushing may be performed by directing pipeline pigs (5*a*, 5*b*) in front of and behind the water-based liquid. The pigs may be a cross-linked gel, based pipeline pig with elastomeric properties. A kit of parts for such a method is also disclosed.

16 Claims, 4 Drawing Sheets

(56) References Cited

FOREIGN PATENT DOCUMENTS

| | | | |
|---|---|---|---|
| EP | 0029243 | A1 | 5/1981 |
| GB | 2167078 | A | 5/1986 |
| GB | 2427173 | B | 1/2010 |
| GB | 2538966 | A | 12/2016 |

OTHER PUBLICATIONS

English language abstract and machine-assisted English translation for CN 104307819 A extracted from espacenet.com database on Aug. 4, 2021, 11 pages.
English language abstract and machine-assisted English translation for CN 107350237 A extracted from espacenet.com database on Aug. 4, 2021, 9 pages.

* cited by examiner

METHOD AND KIT FOR REMOVING TRAPPED HYDROCARBONS

CROSS-REFERENCE TO RELATED APPLICATIONS

The present application is the National Stage of International Patent Application No. PCT/GB2020/050173 filed on Jan. 27, 2020, which claims priority to and all the benefits of GB 1901532.0 filed on Feb. 4, 2019, which are both hereby expressly incorporated herein by reference in their entirety.

This invention relates to a method of removing trapped hydrocarbons.

To allow for maintenance or decommissioning, it is preferred to remove hydrocarbons from pipelines in a plant or offshore facility. Build-up of residual volatile hydrocarbon vapour within the facilities of the process plant may lead to fire or explosions and it is thus extremely hazardous to both personnel and the environment.

A known safety measure is to flush the pipelines with water to displace their potentially hazardous contents and replace them with water. A main (often horizontal) pipeline usually supplies fluid to up-pipes and down-pipes connected thereto. The water flush displaces hydrocarbons in the main pipeline. A water flush will also displace hydrocarbons in the down-pipes but not in the up-pipes and certain other areas, where hydrocarbons often remain.

If the up-pipes have been fitted with drain lines, these trapped pockets of hydrocarbon fluid may be removed; however, there are many instances where this has not been done. In such cases a hot tap is required. Hot tapping is a known method where a drainage channel is introduced whilst the pipeline or pressure vessel continues to be in operation or contains hazardous substances. By its very nature, a hot tap is hazardous, requires careful planning and skilled and experienced personnel. It is classed as "hot work" that is a process that can be a source of ignition when flammable material is present, or it can be a fire hazard regardless of the presence of flammable material. As such, draining of the trapped hydrocarbon fluid using existing hot tapping techniques can take a long time, incur considerable cost and create hazard and associated risk.

An object of the present invention is to mitigate one or more of the shortcomings of the state of the art.

According to the present invention, there is provided a method of removing trapped hydrocarbons from pipework, the pipework comprising a through pipe extending from an inlet to an outlet, and at least one up-pipe extending upwardly from the through pipe, and in fluid communication therewith, the method comprising: flushing the through pipe with a water-based liquid which has a density less than hydrocarbons.

In this way, any hydrocarbons trapped in the at least one up-pipe will be displaced by the lighter water-based liquid, and flushed out of the system.

The at least one up-pipe may be generally vertically orientated (80-100 degrees relative to the absolute horizontal), albeit any slight vertical orientation could still entrap hydrocarbons. Similarly, any downpipe may be vertical in orientation—between 80 and 100 degrees relative to the absolute horizontal. Each may, independently, be orientated between 80 and 100 degrees relative to the through pipe.

The water-based liquid may comprise a plurality of rigid containers, the rigid containers each having a sealed void containing a gas.

Preferably the water-based liquid has a specific gravity of less than 0.98 g/cm$^3$, more preferably less than 0.90 g/cm$^3$ optionally less than 0.78 g/cm$^3$. For certain applications it may even be less than 0.70 g/cm$^3$, or less than 0.65 g/cm$^3$.

The rigid containers may be between 5 microns and 5 mm in diameter, preferably between 10 microns and 500 micron in diameter and more preferably between 20 micron and 200 micron in diameter.

"Rigid" in this context means that the rigid containers are incompressible at the pressures found in use.

The gas in each rigid container may be air, nitrogen, argon or another gas sufficient to achieve a low bulk density.

Preferably the rigid containers are microspheres.

For certain embodiments, the water-based liquid comprises water and microspheres. It may contain miscible solvents such as glycols or alcohols.

The water-based liquid is preferably immiscible with hydrocarbons.

The water-based liquid may include a long chain soluble polymer to act as viscosifying agent and preferably imparting non-Newtonian rheological properties to the fluid forming a flowable gel. Examples of such polymers include Xanthan gum, carboxymethylcellulose and its derivatives, and/or guar and its derivatives.

The viscosity of the water-based liquid may reduce with applied sheer, that is it exhibits thixotropic properties.

Using a Fann 35 type rheometer with Bob1, Rotor 1 and Spring 1, the water-based liquid would, at a 300 rpm dial reading, typically be between 150 (0.15 Pa·s) and 300 (0.3 Pa·s), and at a 3 rpm dial reading typically be between 15 (1.5 Pa·s) and 100 (10 Pa·s). This follows the procedure outlined in "API Recommended Practice for Field Testing Water Based Drilling Fluids, API RP 13B-1/ISO 10414-1".

The method may include directing a pipeline pig with the water-based liquid. The pig can be provided in front of, or behind the water-based liquid. In this way it can, at least partly, clear the through pipe for the water-based liquid, and/or help drive the water-based liquid through the pipeline.

Preferred embodiments, include a pig train, comprising the water-based liquid and a first pig in front of the water-based liquid and a second pig behind the water-based liquid. In this way, the water-based liquid is held between the first and second pipeline pigs.

Any suitable pig can be used.

The pig(s) can be a cylinder comprising a flat base at either end thereof. When compressed along the one axis, preferably it/they can tend to expand along another axis, maintaining the same overall volume, and then in the absence of external forces, they have a shape memory, and so return to their previous shape.

Preferably therefore the pigs are cross-linked gel-based pigs with elastomeric properties, that is it substantially regains its shape after being squeezed, within a second of the release of external 'squeezing' forces. Substantially regaining its shape is returning to between 90% and 110% of the previous length of each of the x, y and z axis; usually between 95% and 105% or between 98% and 102%.

The dynamic viscosity of the gel pig is typically more than 2000 Pa·s to essentially solid materials which do not flow and thus have a viscosity of over 5,000,000 Pa·s.

The pigs may be a water-based or silicone based.

One suitable composition for the pig comprises: a silicone based oil fluid, a siloxane, silica, microspheres, and a catalyst, the base fluid comprising a polyalphaolefin based oil. The silicone based oil may be a non-reactive, straight chained polydimethylsiloxane. The siloxane may comprise a polydimethylsiloxane, a polysiloxane or a combination of polydimethylsiloxane and polysiloxane. The polydimethylsiloxane may be a vinyl terminated polydimethylsiloxane. The polysiloxane may be a methyl hydrogen polysiloxane.

There may be a plurality of up-pipes between the through pipe inlet and outlet. The volume of hydrocarbons to be displaced in the at least one, or all, up-pipes is normally less than the volume of water-based liquid used to flush the through pipe. For certain embodiments, such a volume may be provided between the first and second pig.

A pre-flush using water (or water-based liquid with a density greater than hydrocarbons) may also be performed. This can remove any hydrocarbons in the through pipe and also remove hydrocarbons in any down-pipes, the down-pipes extending downwardly and in fluid communication with the through pipe.

The through pipe may be provided in various process plants or on an offshore oil and gas facility. The method may be used as part of a process to make-safe an offshore facility during decommissioning.

According to a further aspect of the invention there is provided a kit of parts for performing the method described herein, the kit of parts including the water-based liquid.

Optional components and optional features used in the method described herein are also optional component or features which may be included in the kit of parts, for example at least one pipeline pig, especially a cross-linked gel based pipeline pig with elastomeric properties.

Embodiments of the present invention will now be described by way of example only and with reference to accompanying figures, in which.

Figure 1:
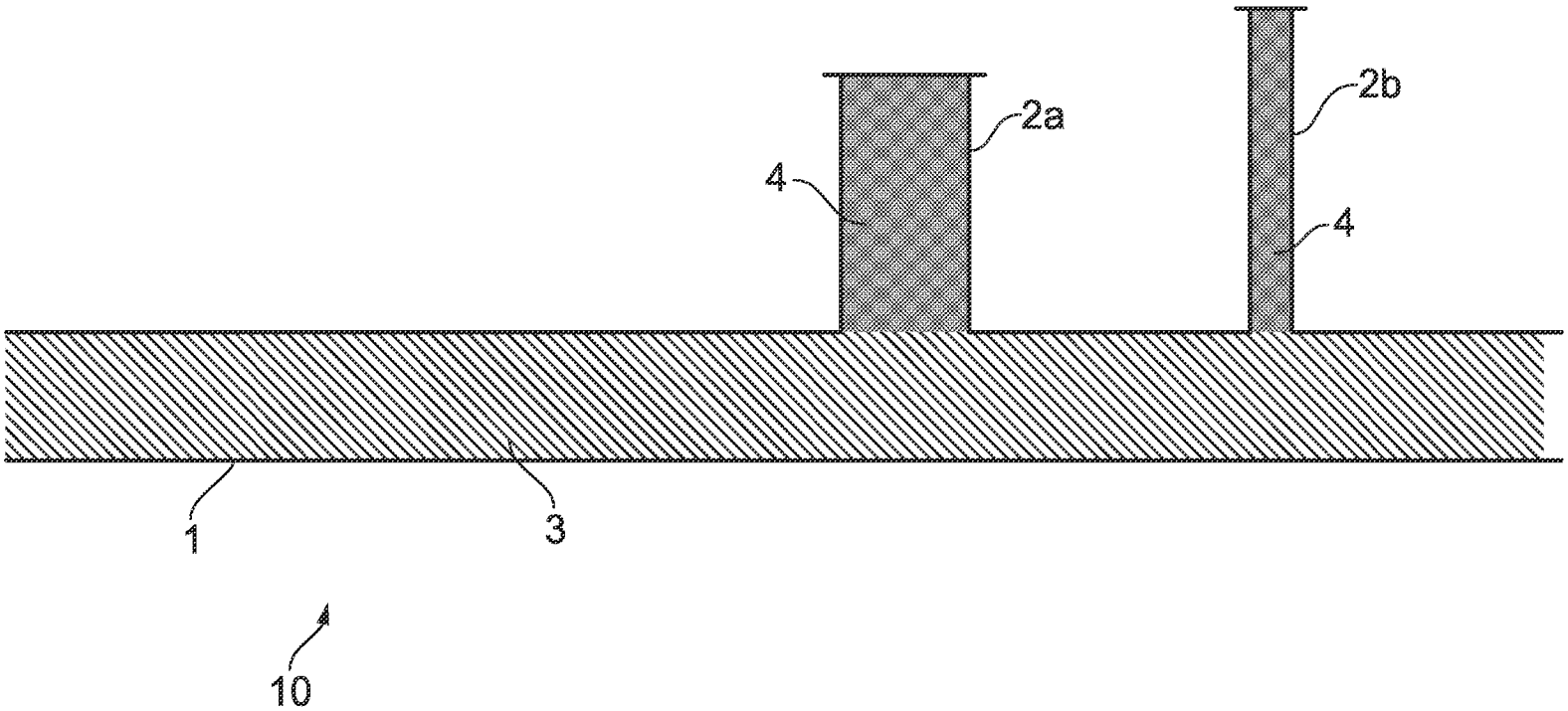
FIG. 1 shows a schematic cross-sectional diagram of a section of a process plant.

FIG. 1 shows a cross-sectional diagram of a section of a process plant 10 comprising a main through pipe 1 and two up-pipe sections 2*a*, 2*b*. After a water flush, hydrocarbon fluid 4 is trapped in the up-pipe sections 2*a*, 2*b* due to its lower density compared with water 3.

Figure 2:
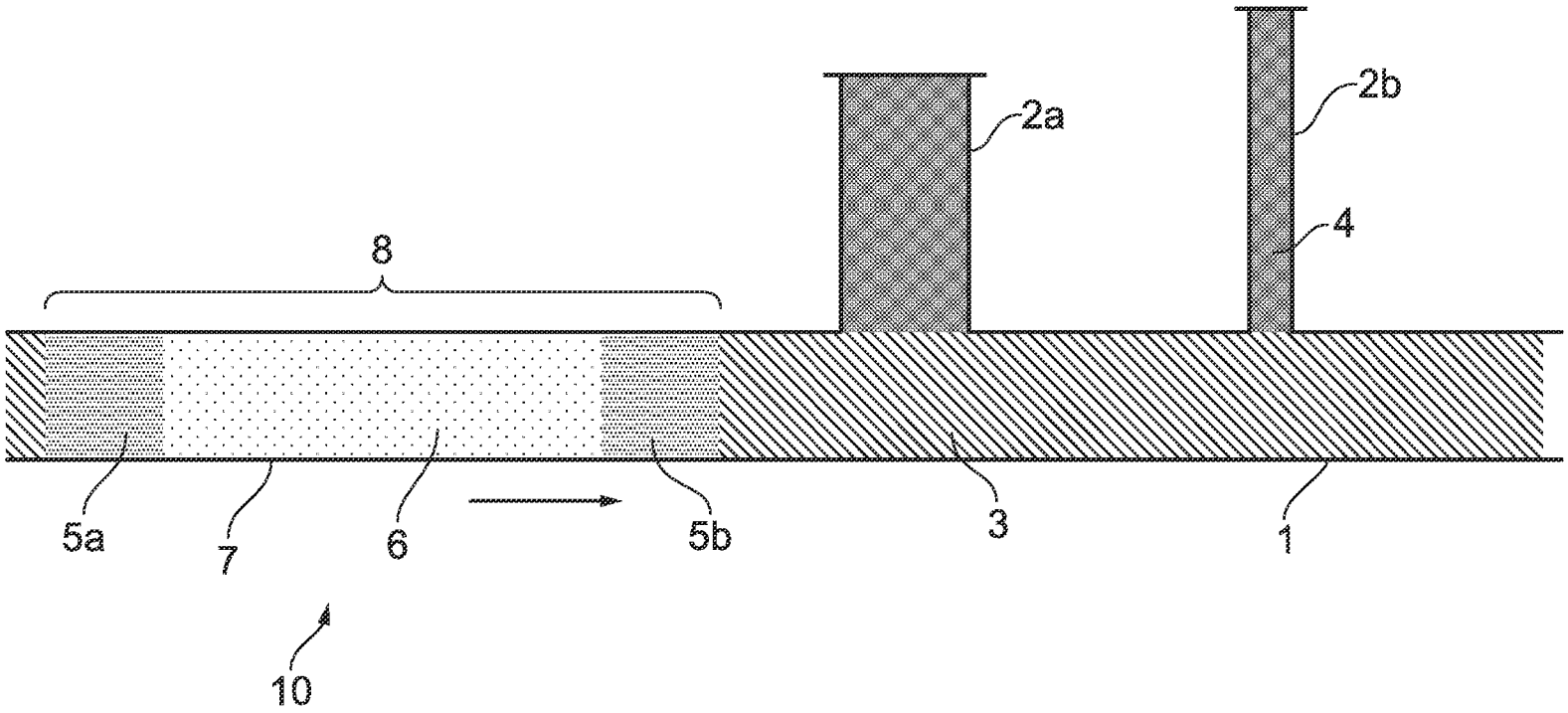
FIGS. 2 to 4 are a series of sequential views showing a pig train arrangement moving through the FIG. 1 process plant, in accordance with the present invention.

In FIG. 2, a pig train 8 is introduced upstream of the trapped hydrocarbon fluid 4. The pig train 8 comprises two gel pigs 5*a*, 5*b* placed such that, along with the main pipe 1, they define a section therebetween which is filled with a water-based liquid 6 having a lower density than the hydrocarbon fluid 4.

Figure 3:
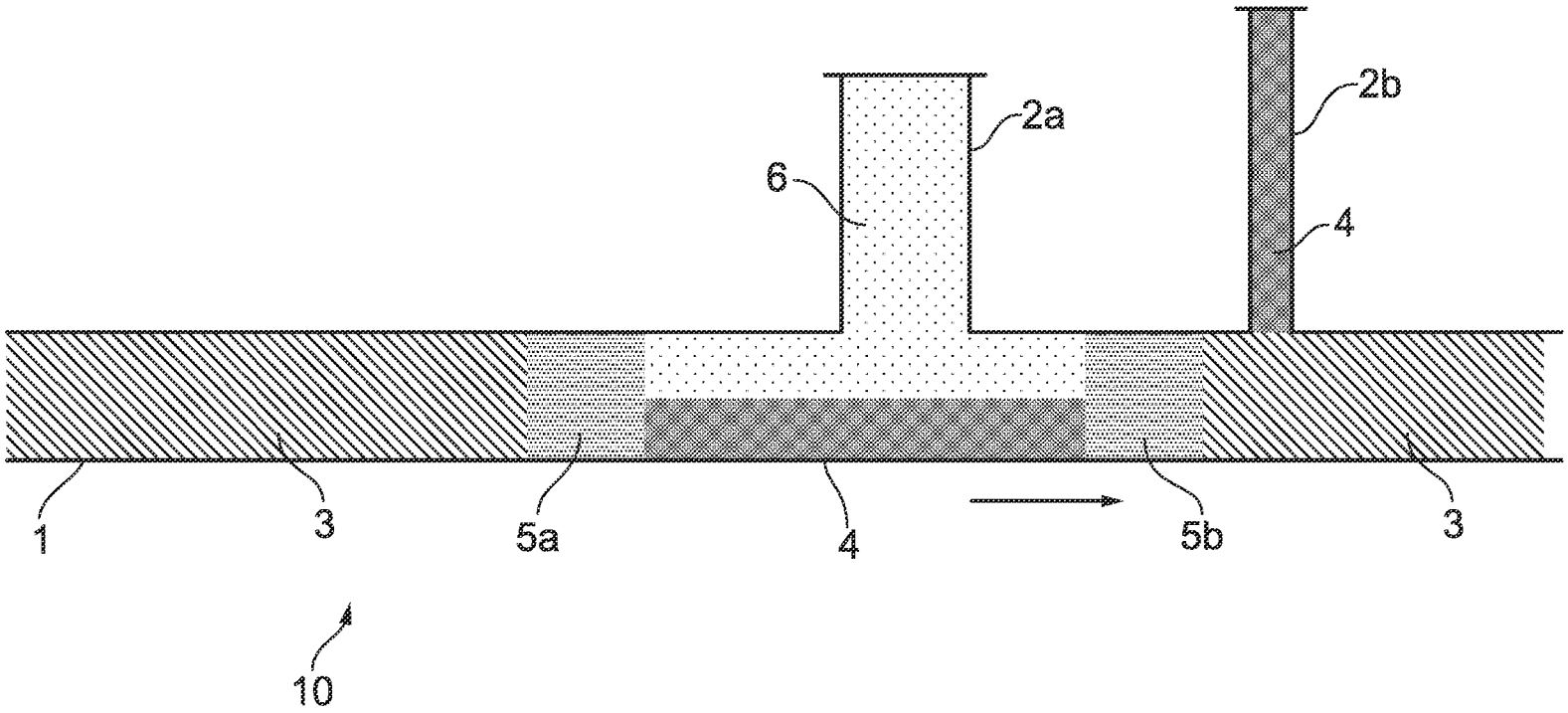

In use, the pig train 8 is moved towards the up-pipe sections 2*a*, 2*b* by action of pumped water behind the pig 5*a*. In FIG. 3, the water-based liquid 6 within the pig train 8 is in fluid communication with the first of the up-pipe sections 2*a*. Since the water-based liquid 6 has a lower density than hydrocarbon fluid 4, the hydrocarbon fluid 4 is displaced by some of the water-based liquid 6, out of the first up-pipe section 2*a* and into the section of the main pipe 7 between the pigs 5*a*, 5*b*, and sealed from the rest of the main pipe 1.

Figure 4:
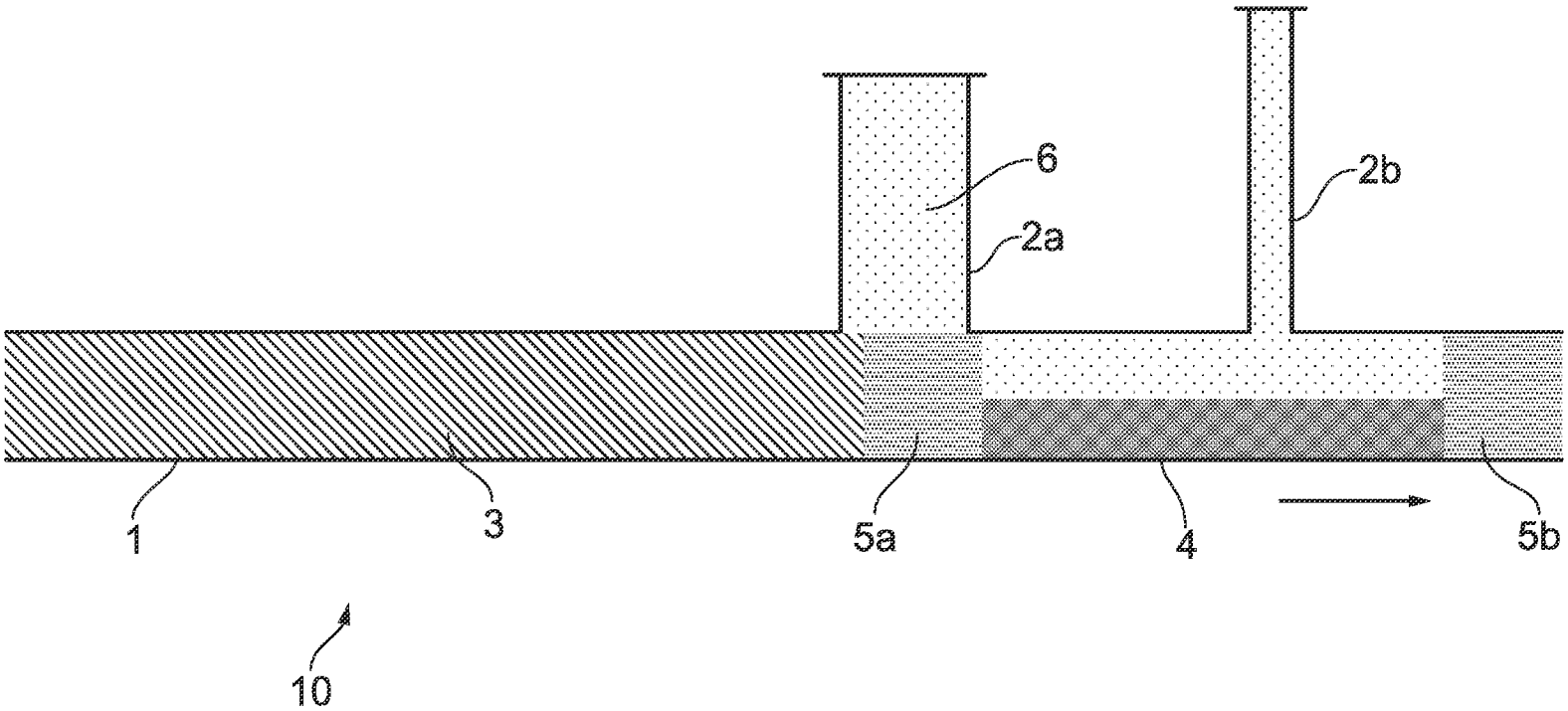

In FIG. 4, the pig train 8 comprises hydrocarbon fluid 4 that had been displaced out of section 2*a* and the remaining water-based liquid 6. The fluids are segregated by the action of gravity such that the hydrocarbon fluid 4 is located below the water-based liquid 6. The pig train 8 reaches the second up-pipe section 2*b* filled with hydrocarbon fluid 4. Similarly, the hydrocarbon fluid 4 is displaced out of the second up-pipe section 2*b* and into the section of the main pipe 7, and contained between the gel pigs 5*a*, 5*b*. At this stage, the pig train 8 comprises hydrocarbon fluid 4 that had been displaced out of sections 2*a*, 2*b*, overlaid with the remaining water-based liquid 6.

Once the pig train 8 passes the up-pipe sections 2*a*, 2*b* the hydrocarbon fluid 4 is fully displaced therefrom leaving the upright sections 2*a*, 2*b* filled with non-hazardous water-based liquid 6. The pig train 8 is then moved away from the upright sections 2*a*, 2*b* to conveniently transport the hydrocarbons away from the up-pipes 2*a*, 2*b* and out of the through pipe 1. Upon encountering a waste receptacle, the fluids are released thereto from the pig train 8, with the water-based liquid 6 overlaying the hydrocarbon fluid 4, thus rendering the up-pipes of the process plant 10 safe.

The pig train 8 comprising the water-based liquid 6 and gel pigs 5*a*, 5*b* provides a safer and more effective method of removing trapped hydrocarbon fluid from up-pipe sections 2*a*, 2*b* than the other methods known in the art.

Thus, for certain embodiments, the section of the process plant 10 may be cleaned and rendered safe in a single pass.

The waste receptacle (not shown) is provided at the outlet of the through pipe 1, downstream of the upright sections 2*a*, 2*b*. Upon discharge of fluids from the pig train 8 into the waste receptacle, the water-based liquid 6 floats atop the hydrocarbon fluid 4 in the receptacle (because of its lower density) thus acting as a safety barrier to the release of volatile hydrocarbon vapour. The barrier can be increased by adding quantities of the water-based liquid 6 to the waste receptacle. Once the treatment is complete, the waste can be processed, water and hydrocarbon fluid 4 can be drawn off and the water-based 6 fluid can be reused.

The gel pigs 5*a*, 5*b* can form a tight seal against the inner walls of the main pipe 1, thereby providing a swabbing action. They are also able to contain fluids within the pig train 8, while being movable through long stretches of pipeline of varying diameters and able to navigate through any encountered geometric changes therein.

The gel pigs 5*a*, 5*b* can negotiate short radius bends of 1.5D with the ability to regain their original shape. With an operating temperature range of −25 and 140° C., the gel pigs 5*a*, 5*b* can be propelled through the main pipe 1 by gas or liquids and do not require pig launchers or receivers.

One composition of the gel pigs 5*a*, 5*b* is sold by Aubin Ltd under the trade name EVO-Pig LG. Suitable pigs are described, but not limited to those disclosed in UK Patent Application number GB2538966, the disclosure of which is incorporated herein by reference, in its entirety.

The exact composition of the water-based liquid 6 may be adjusted. Any non-hazardous bulk fluid immiscible with the hydrocarbon fluid may be used as the continuous phase, especially mixtures of water with other water miscible solvents, such as glycols and alcohols. For this embodiment, the water-based liquid 6 comprises: water acting as the continuous phase, a long chain water-soluble polymer which acts as a viscosifying agent preferably imparting non-Newtonian rheological properties to the fluid forming the gel, and microspheres which lower the fluid bulk density to less than 0.7 kg/litre, and therefore below the range of density values characteristic of the trapped hydrocarbon fluid 4. Examples of suitable the long-chain water-soluble polymer Xanthan gum, Carboxymethylcellulose and its derivatives, and Guar and its derivatives. In any case, the water-based liquid is preferably non-hazardous and environmentally acceptable.

The volume of the water-based liquid 6 provides sufficient excess over the sum of the volumes of trapped hydrocarbons, usually of the entire up-pipe sections 2*a*, 2*b*. Optionally, sufficient water-based liquid 6 may also be included such as to cover the entire surface area of the inlet of the waste receptacle.

Multiple upright sections can be treated sequentially in this manner, limited only by the volume of water-based liquid 6 provided in the pig train 8. As such, the process may be extended to main pipes with multiple up-pipes which can be treated in one pass. The method may be repeated as necessary for the whole process plant or offshore facility.

In another embodiment, the section of the process plant 10 is flushed with the water-based liquid 6 following or before the insertion of a single gel pig into the main pipe 1. The single gel pig can be one of the gel pigs 5*a*, 5*b*. This embodiment has similar advantages to the previous embodiment, but it requires the use of a single pig instead of two pigs.

In yet another embodiment, the section of the process plant 10 is flushed with the water-based liquid 6 without the use of gel pigs 5*a*, 5*b*. This embodiment has similar advantages to the previous embodiments, but it does not require the use of pigs.

In alternative embodiments, where pigs are used, a cup-pig such as a conical cup-pig may be used instead of the gel pigs shown here.

Modifications and improvements can be incorporated herein without departing from the scope of the invention.

The invention claimed is:

1. A method of removing trapped hydrocarbons from pipework, the pipework comprising a through pipe extending from an inlet to an outlet, and at least one up-pipe extending upwardly from the through pipe, and in fluid communication therewith, the at least one up-pipe containing the hydrocarbons;

the method comprising:

flushing the through pipe with a water-based liquid;

wherein the water-based liquid comprises a plurality of rigid containers, the rigid containers each having a sealed void containing a gas which lowers the density of the water-based liquid to less than that of the hydrocarbons; and displacing the hydrocarbons trapped in the at least one up-pipe into the through pipe, by the water-based liquid.

2. A method as claimed in claim 1, wherein the water-based liquid has a specific gravity of less than 0.98 g/cm.

3. A method as claimed in claim 2, wherein the rigid containers comprise microspheres.

4. A method as claimed in claim 1, wherein the rigid containers comprise microspheres.

5. A method as claimed in claim 4, including directing a pipeline pig into the through pipe, along with the water-based liquid.

6. A method as claimed in 1, including directing a pipeline pig into the through pipe, along with the water-based liquid.

7. A method as claimed in claim 6, wherein the pipeline pig is a crosslinked gel-based pipeline pig with elastomeric properties.

8. A method as claimed in 1, including directing a pipeline pig train into the through pipe, the pipeline pig train comprising the water-based liquid, a first pipeline pig in front of the water-based liquid and a second pipeline pig behind the water-based liquid.

9. A method as claimed in claim 8, wherein each pipeline pig is a cross-linked gel-based pipeline pig with elastomeric properties.

10. A method as claimed in 1, wherein the water-based liquid comprises miscible solvents.

11. A method as claimed in 1, wherein the water-based liquid includes a long chain soluble polymer to act as viscosifying agent, such that the water-based liquid has a viscosity at a 300 rpm dial reading of between 150 (0.15 Pa·) and 300 (0.3 Pa·) and at a 3 rpm dial reading of between 15 (1.5 Pa·) and 100 (10 Pa·).

12. A method as claimed in 1, wherein there is a plurality of up-pipes between the through pipe inlet and through pipe outlet.

13. A method as claimed in claim 12, wherein during a single pass of the water-based liquid from the through pipe inlet to the through pipe outlet, it is in fluid communication with each up-pipe of the plurality of up-pipes.

14. A method as claimed in claim 1, wherein the method includes a pre-flush using a different water-based liquid, the different water-based liquid having a density greater than that of the hydrocarbons, before flushing the through pipe with the water-based liquid which has a density less than the hydrocarbons.

15. A method as claimed in claim 1, wherein the through pipe is provided on an offshore oil and gas facility.

16. A method as claimed in claim 1, wherein the water-based liquid has a specific gravity of less than 0.90 g/cm$^3$.

* * * * *